US006367799B1

(12) United States Patent
Sippel

(10) Patent No.: US 6,367,799 B1
(45) Date of Patent: Apr. 9, 2002

(54) PLAYING CARDS AND CASE THEREFOR

(75) Inventor: Valerie Sippel, Toronto (CA)

(73) Assignee: Umbra, Inc., Buffalo, NY (US)

( * ) Notice: Subject to any disclaimer, the term of this patent is extended or adjusted under 35 U.S.C. 154(b) by 0 days.

(21) Appl. No.: 09/796,502

(22) Filed: Mar. 1, 2001

(51) Int. Cl.[7] ..... A63F 1/02; A63F 1/10

(52) U.S. Cl. ..... 273/294; 273/292; 273/293; 273/148 A; D21/376; D21/378; D21/392; D21/394

(58) Field of Search ..... 273/294, 293, 273/148 A, 292; D21/42–47, 55, 57, 376, 378, 392, 394

(56) References Cited

U.S. PATENT DOCUMENTS

| | | | | |
|---|---|---|---|---|
| D9,011 S | * | 2/1876 | Duthie | 273/294 |
| D9,158 S | | 3/1876 | Duthie | |
| 681,925 A | | 9/1901 | O'Neill | |
| 1,684,372 A | | 9/1928 | Maennlein | |
| 1,775,782 A | | 9/1930 | Pearson | |
| D96,118 S | | 7/1935 | Keshishian | |
| D126,404 S | | 4/1941 | Nussgruber | |
| D131,480 S | | 3/1942 | Patterson | |
| D138,177 S | | 7/1944 | Field | |
| D159,476 S | | 8/1950 | Davis | |
| D169,847 S | | 6/1953 | Inman | |
| 2,663,418 A | | 12/1953 | Grunwals | |
| 3,143,348 A | | 8/1964 | Carsen et al. | |
| 3,667,759 A | | 6/1972 | Barr | |
| 4,192,513 A | | 3/1980 | Feeley et al. | |
| 5,106,103 A | * | 4/1992 | Fiore | 273/459 |
| D381,732 S | | 7/1997 | Tenor, II | |
| 5,788,241 A | | 8/1998 | Ung | |
| 6,070,876 A | | 6/2000 | Ko | |

FOREIGN PATENT DOCUMENTS

| | | | | |
|---|---|---|---|---|
| GB | 3058 | * | 2/1913 | 273/294 |

OTHER PUBLICATIONS

"Brain Quest", The Game Keeper's Game Sampler 1994–1995 catalog, p. 12, Workman Publishing.*

* cited by examiner

*Primary Examiner*—Benjamin H. Layno
(74) *Attorney, Agent, or Firm*—SAIDMAN DesignLaw Group

(57) ABSTRACT

The combination of a deck of playing cards and a carrying case for them. Each of the cards in the deck of playing cards are elongated, have rounded semicircular ends connected by linear sides, suitable card names and denominations printed in the upper left and lower right corners, and have a height to width ratio in the range of 3.0 to 3.8. The carrying case is shaped to fit the deck of cards, is elongated with rounded ends and has a generally truncated ellipsoidal shape. The carrying case opens from the middle with the opening of each end having an oval shape. When closed, the top end telescopes snugly and securely with the bottom end.

26 Claims, 4 Drawing Sheets

PLAYING CARDS AND CASE THEREFOR

BACKGROUND OF THE INVENTION

1. Field of The Invention

This invention relates to playing cards in combination with a carrying case therefor.

2. Description of Related Art

Playing cards are traditionally rectangular with slightly rounded corners. They are manufactured primarily in two sizes, Poker and Bridge, so called because of the games most commonly associated with them. Both are of a standard height, namely, three and a half inches. Poker cards are usually held no more than five at a time, so their width is relatively large, two and a half inches. Dividing the height by the width, it can be shown that standard Poker cards have a height to width ratio of 1.40. Most prior art patents showing playing cards have height to width ratios in the same ballpark. (The height to width (h/w) ratios of cards shown in the mentioned prior art patents are based on measurements of the proportions of the cards as shown in their drawings.) Representative are U.S. Pat. No. Des. 9,158, issued to Duthie on Mar. 21, 1876, and U.S. Pat. No. Des. 169,847, issued to Inman on Jun 16, 1953 having height to width ratios of 1.40 and 1.38, respectively. Prior art utility patents include U.S. Pat. No. 681,925, issued to O'Neill on Sep. 3, 1901 (h/w=1.44); U.S. Pat. No. 1,775,782, issued to Pearson on Sep. 16, 1930 (h/w=1.35); and U.S. Pat. No. 2,663,418, issued to Grunwald on Dec. 22, 1953 (h/w=1.38). Other rectangular cards having different ratios are known, but they are rare, e.g., U.S. Pat. No. Des. 138,177 issued to Field on Jul. 4, 1944, which has a height to width ratio of 2.74. The accepted norm for regular rectangular playing cards is a height to width ratio of approximately 1.40.

Bridge cards are designed for playing Contract Bridge wherein all of the cards of the deck are dealt out equally to four players, each receiving thirteen cards, a more difficult number of cards to hold at one time. To facilitate holding them comfortably, bridge cards have a lesser width, two and one-quarter inches. Bridge cards, therefore, have a height to width ratio of 1.56. This ratio is approximately the same as that for regular sizes of playing cards.

Oval cards with semicircular ends are known. See U.S. Pat. No. Des. 9,011, issued to Duthie on Feb. 22, 1876, U.S. Pat No. Des. 131,480, issued to Patterson on Mar. 3, 1942, and U.S. Pat. No. Des. 159,476, issued to Davis on Aug. 1, 1950; they have height to width ratios of 1.38, 9.00, and 1.48, respectively. Duthie and Davis maintained the standard height to width ratio, while Patterson differed greatly. Patterson calls his invention a "set of game pieces" without identifying them more specifically, so it is not definitely known whether or not the "pieces" are playing cards. He never explains how they are used. At a nine to one ratio, however, they are difficult to hold, separate, and manipulate. Maennlein, U.S. Pat. No. 1,684,372, issued on Sep. 11, 1928, discloses a deck of metal playing cards with semicircular ends; their height to width ratio of 15.75 make them, at best, awkward to use.

Three unusually shaped cards are worth mentioning in passing: U.S. Pat. No. Des. 96,118, issued to Keshishian on Jul. 2, 1935; Des. 126,404, issued to Nussgruber on Apr. 8, 1941; and U.S. Pat. No. 4,192,513, issued to Feeley et al. on Mar. 11, 1980. Keshishian discloses "egg shaped" cards having a height to width ratio of 1.61, Nussgruber discloses irregularly shape cards, roughly a smoothed-out "key-hole" having a height to width ratio of 1.63, and Feeley et al. disclose diamond shaped cards having a nominal height to width ratio of 2.0. In spite of the differences in overall contours, none strays far from the standard height to width ratio of about 1.4–1.5.

The height to width ratios of standard cards were developed and accepted based on the average size of the human hand. They are successful, because they generally fit in most palms comfortably. For many, however, especially those with smaller hands, including children, or hands afflicted with manipulation problems, such as caused by arthritis, their widths are too large to be comfortably held. There are many "joke" decks that have either drastically reduced or enlarged the sizes of the cards while maintaining a constant height to width ratio, but they are not seriously used to play card games. A need exists for a viable alternative to standard cards. Simply reducing the widths, while maintaining the height to width ratio, does not produce a usable deck of cards. The height of the cards must also be ergonomically selected to provide a deck that is not only comfortable to hold but which can be shuffled and sorted easily.

Carrying cases for playing cards traditionally are rectangular to correspond to the shape of the cards held therein. Given the standard width of the normal deck, the carrying cases are difficult to fit into the pockets of one desiring to bring them to the game, and their sharp corners can make them uncomfortable as well.

OBJECTS AND SUMMARY OF THE INVENTION

The present invention overcomes the difficulties described above by providing a deck of cards, substantially oval in aspect with semicircular ends, and a stylish carrying case having a smoothly contoured outer surface, essentially resembling a truncated ellipsoid.

It has been found that a height of five inches with a height to width ratio in the range of about 3.0 to 3.8, specifically 3.3 to 3.4, results in a deck of playing cards which suprisingly is user-friendly, combining being comfortable to hold and easy to manipulate in a deck that is extremely aesthetically pleasing, a refreshing change from the same, centuries old, boring style.

The width is sufficient to give a solid, secure feel when handling the cards, and the length allows the designating indicia to protrude sufficiently beyond the palm to be easily and clearly visible without being ungainly or grotesque. The rounded, semicircular ends make shuffling the cards easy and comfortable.

The carrying case is roughly six inches long and two and one-quarter inches in width, and, as aforesaid, is smoothly contoured. The combination is an easily carried case for a deck of cards that fits comfortably in a pocket or purse.

An object of the invention is to provide a deck of cards which fits easily and comfortably in the hand, even when holding a large number as when playing contract bridge.

Another object of the invention is to provide a deck of cards and a carrying case which is comfortable to carry and surprisingly easy to use.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
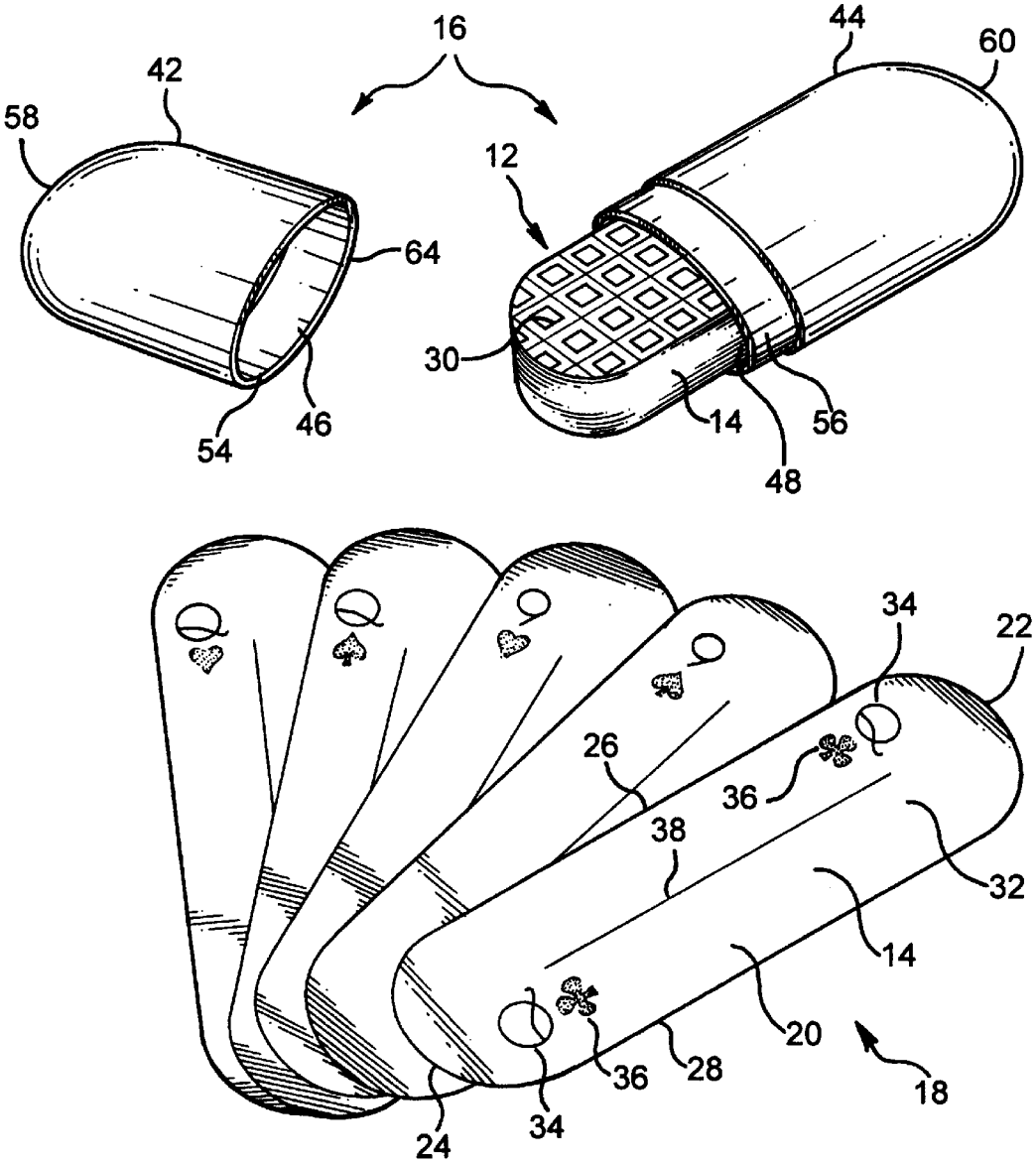
FIG. 1 is a perspective view that illustrates a preferred embodiment of the present invention.
Figure 2:
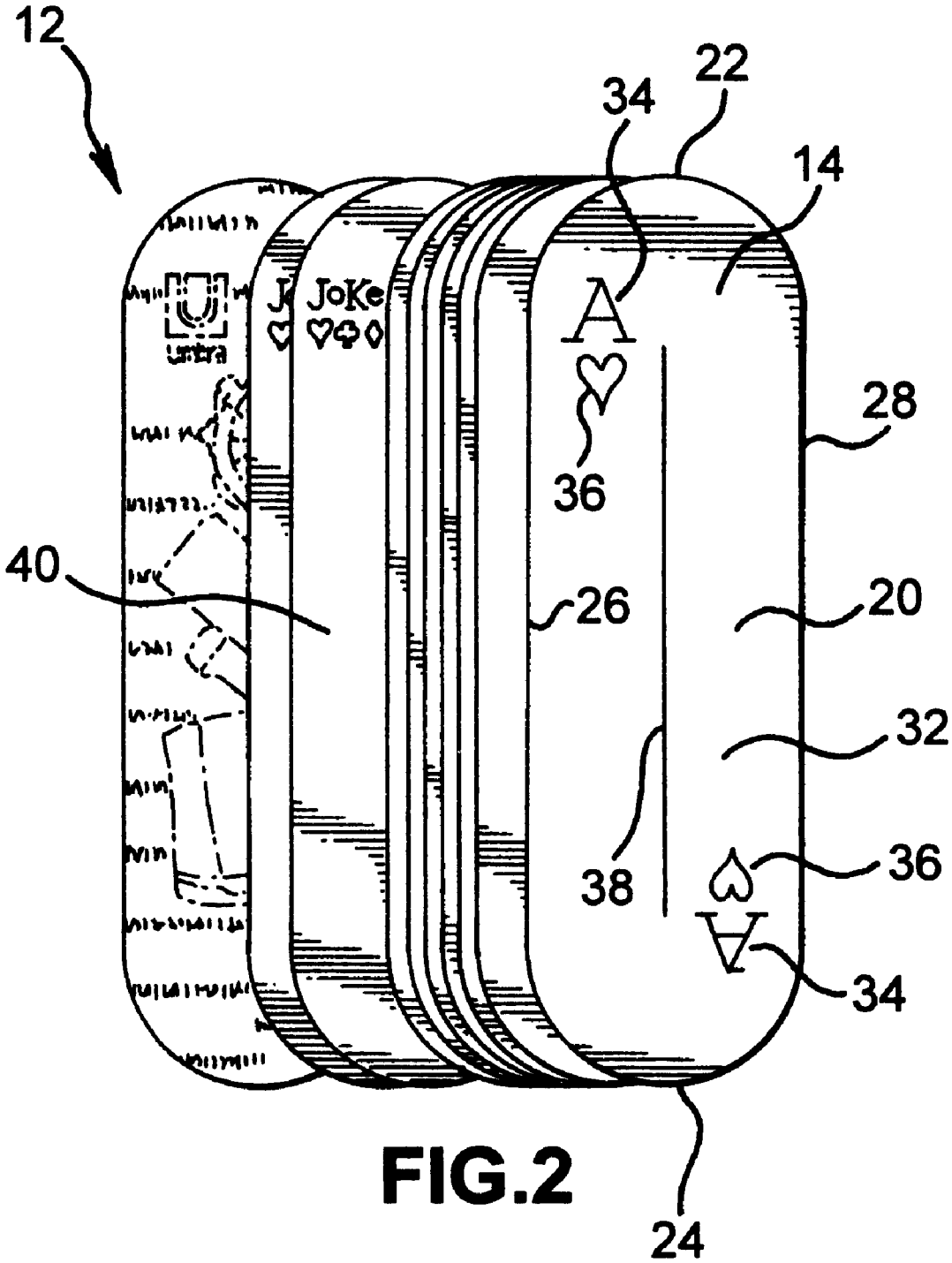
FIG. 2 is a front view of the playing cards of the embodiment of FIG. 1.

Referring to FIG. 1, the preferred embodiment comprises a combination 10 of a deck 12 of playing cards 14 and a carrying case 16. Carrying case 16 is shown opened with deck 12 protruding therefrom. A Poker "hand" 18 comprising a full house, Queens over Nines, is fanned out as if cards 14 are in play.

Cards 14 are preferably made of conventional playing card materials, e.g., a plasticized cardboard, and each individual card 14 is planar with a thickness corresponding to that of usual playing cards. As is necessary for each card to be indistinguishable from the others when viewed from the back, each card has the same configuration as the other cards, namely, an elongated body 20 with an upper rounded, in this case semicircular, end 22 and a lower rounded, in this case semicircular, end 24 joined smoothly together by a pair of substantially linear sides 26 and 28. The backs 30 of cards 14 (FIG. 1) have printed thereon a design, picture, logo, or other image, as is conventional. The faces 32 of cards 14 have indicia printed thereon depicting the card's name or rank 34 and its denomination or suit 36. Only the rank/suit combination (printed upright at the upper left corner of card 14) and the same rank/suit combination (printed upside down at the lower right corner of card 14) are needed for identification of card 14. The "pips" usually found on standard cards, e.g., ten club symbols for the ten of clubs are not necessary for an easy identification of the cards and would be unsightly when forced within the narrower width of the present invention, so they are omitted by design. Preferably, some type of decorative indicia such as line 38 may be included to visually connect the two ends of cards 14.

The dimensions of cards 14 are an important feature of the invention. The ratio of height to width, as measured along the longitudinal axis from top 22 to bottom 24, and transversely from side 26 to side 28, respectively, is selected to be within the range of 3.0 to 3.8, preferably between 3.3 and 3.5, and even more preferably, substantially 3.4. These height to width ratios have been found to provide cards which are easy to shuffle, hold, sort, and fan. For instance, the preferred height is five inches and the width is 1 15/32 inches. This combination has a height to width ratio of 3.4 that, even though over twice the accepted norm, has been found to be surprisingly comfortable to use. Being narrower than standard widths, a handful of cards, e.g., the thirteen cards of a bridge hand, can be fanned sufficient for easy viewing without over-extending the hand's ability to easily grasp the cards. At the same time, the substantially one and one-half inch width provides a substantial feel of solidity, which provides confidence and security to the player. Thus, a more secure, unstrained gripping of a plurality of cards is attained. Due to the larger than standard heights of the cards, the rank and suit printed at the upper end of each card can be clearly exposed using a smaller fanning angle than with standard cards, thereby reducing the left-to-right tensions on the hand as it stretches to hold the fanned cards. No deck of cards known to the inventor possesses these dimensions or the concomitant advantages. Cards shorter than five inches can be designed for small hands, and longer than five inches for larger hands. Surprisingly, it is the height to width ratio, preferably 3.4, which allows the present invention to be adapted to any given hand size while providing the requisite feel and readability thereof.

The deck comprises as many cards with appropriate indicia as required by the game for which it is intended. For example, Poker or Bridge decks will include fifty-two cards (plus jokers 40 where desired) consisting of the four suits (Spades, Hearts, Diamonds, and Clubs), with each suit including thirteen cards ranked as usual (Ace, King, Queen, Jack, Ten, Nine, Eight, Seven, Six, Five, Four, Three, and Two). A Pinochle deck would include two each of the cards Ace, King, Queen, Jack, Ten, and Nine in the same four suits, for a total of forty-eight cards. The preferred embodiment of the present invention comprising a combination of playing cards and carrying case can be adapted to any standard card game.

Figure 3:
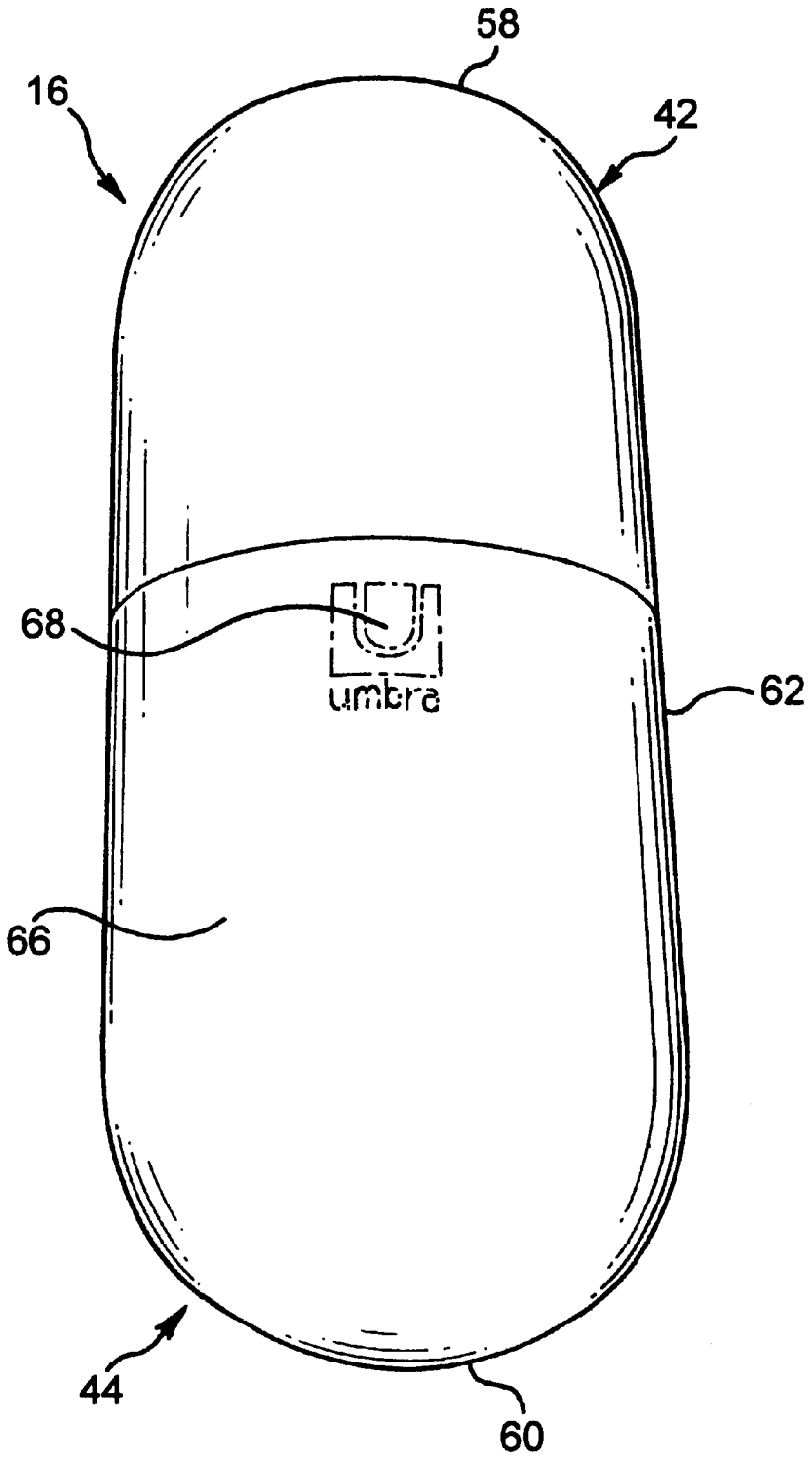
FIG. 3 is a front perspective view of the carrying case.
Figure 4:
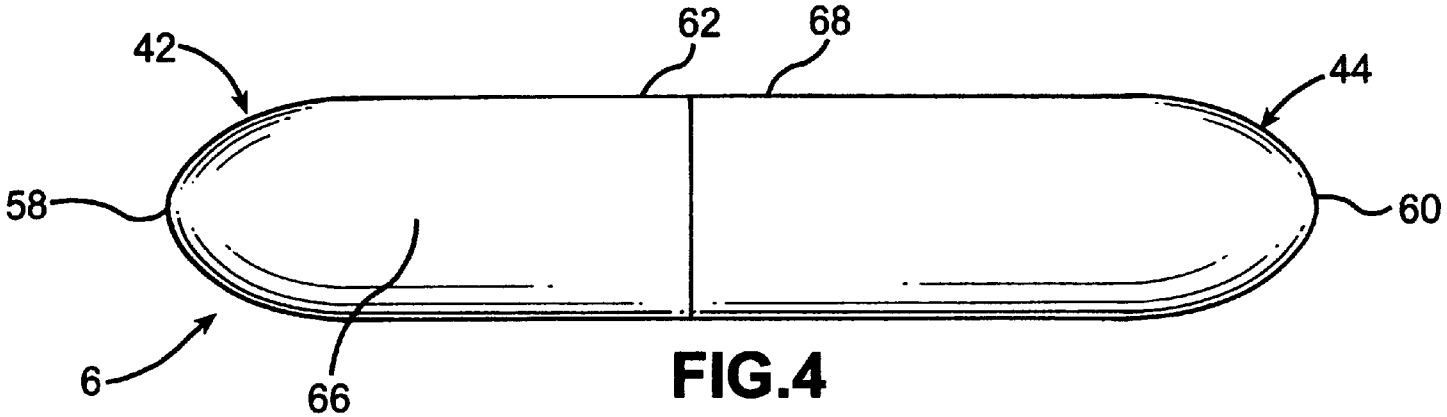
FIG. 4 is a side perspective view of the carrying case.
Figure 5:
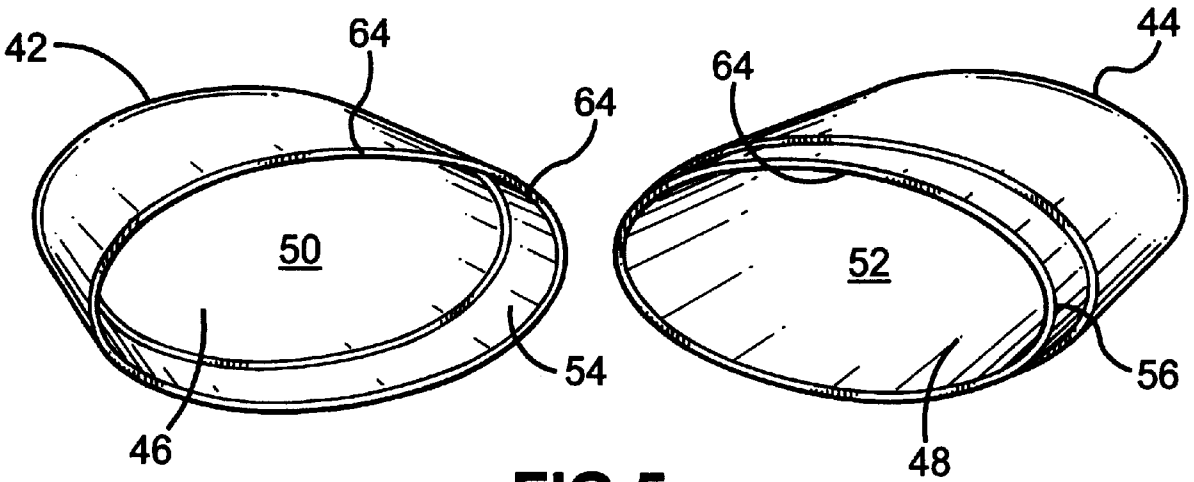
FIG. 5 is a perspective view of the ends of the carrying case when opened.

Carrying case 16 is preferably molded of plastic and can be translucent, as shown in FIGS. 1 and 3–5, transparent, or opaque in a variety of colors. Carrying case 16 comprises two parts, a top 42 and a bottom 44, both of which are cup-shaped with an open end 46 and 48, respectively, allowing access to hollow interiors 50 and 52 (FIGS. 1 and 5). Complementary recessed strips 54 and 56 circumscribe top 42 and bottom 44 adjacent to open ends 46 and 48. Recess 54 is shown as being internally of top 42, and recess 56 is shown as external of bottom 44, but obviously they can be reversed with the external recess being formed on top 42 and the internal recess being formed in bottom 44. When top 42 and bottom 44 are telescopically joined to close case 16, recesses 54 and 56 preferably overlap by about one-half inch to form a snug fit which reliably but releasably seals case 16.

When closed, the overall shape of carrying case 16 loosely mirrors that of deck 12. Upper and lower rounded ends 58 and 60 are joined smoothly together by a cylindrical body 62 having an essentially elliptical or oval cross-sectional shape 64 as shown by the open ends 46 and 48 (FIGS. 1 and 5). The axial length of case 16 when closed between rounded ends 58 of top 42 and 60 of bottom 44 is slightly longer than the height of cards 14, and the transverse dimensions of cylindrical body 62 are slightly more than the cross-sectional dimensions of cards 14. In the preferred dimensions of cards 14 given illustratively above, an axial length of six inches, a width of two and one-quarter inches, and a depth of one inch allows room for deck 12 to be easily inserted into and removed from case 16.

The relative longitudinal length proportions of top 42 and bottom 44 may be selected as desired, so long as a sufficient length of cards 14 protrude from bottom 44 when top 42 has been removed that the player can easily and securely grasp the exposed ends of cards 14. Axial lengths of approximately two and three-quarters inches and three and three-quarters inches for top 42 and bottom 44 have been found especially suitable.

As is readily apparent from FIGS. 3–5, the external contours 66 of case 16 are everywhere smoothly rounded with no sharp corners and no planar surfaces. When viewed from any direction, front, back, either end, either side, and in cross-section, the visage is of an oval, almost ellipsoidal, body. This smoothness of external configuration lends case 16 to being easily and comfortably stored in one's purse, bag or pocket, and adds to its aesthetic appeal.

The external surface 66 of case 16 is readily adapted to advertising, as illustrated by the logo 68 imprinted on the front of case 16.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the Abstract is to enable the U.S. Pat. and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

I claim as my invention:

1. A deck of cards, comprising:

at least one standard deck of playing cards comprising four suits of thirteen differently ranked cards each, each card comprising:

a planar body having a front, a back, an upper end and a lower end, said upper and lower ends being rounded and joined by a pair of substantially linear sides;

said back including a decorative image printed thereon;

said front including indicia, which designates said four suits, and said thirteen differently ranked cards of the standard deck of playing cards;

the longitudinal distance between said upper and lower ends defining the height of said card and the transverse distance between said pair of substantially linear sides defining the width of said card, each of said cards in said deck having the same heights and same widths; and the height to width ratio of each of said cards being within the range of 3.0 to 3.8 for optimum holding and viewing of a hand of said cards when playing standard poker, bridge or similar card game.

2. The deck of cards as in claim 1 wherein said height to width ratio is within the range of 3.3 to 3.5.

3. The deck of cards as in claim 2 wherein said height to width ratio is approximately 3.4.

4. The deck of cards as in claim 2 wherein said height is substantially five inches and said width is substantially one and one-half inches.

5. The deck of cards as in claim 1 wherein said identifying indicia comprises a name denoting the rank of the card and a denomination denoting the suit of the card.

6. The deck of cards as in claim 5 wherein said name and denomination are printed upright in the upper left corner of each of said cards and said name and denomination are printed upside down in the lower right corner of each of said cards.

7. The deck of cards of claim 1 wherein said four suits comprise Spades, Hearts, Diamonds, and Clubs, and said thirteen differently ranked cards comprise an Ace, King, Queen, Jack, ten, nine, eight, seven, six, five, four, three, and two.

8. The deck of cards of claim 1, wherein said upper and lower ends are semicircularly shaped.

9. A playing card/case combination, comprising:

at least one standard deck of playing cards comprising playing cards divided into four suits, each suit including 13 differently ranked cards, each of said playing cards comprising a planar card having an elongated body with rounded ends and a height to width ratio within the range of 3.0 to 3.8for optimum holding and viewing of a hand of said cards when playing standard poker, bridge or similar card game; and a carrying case for said deck, said carrying case comprising a top and a bottom, said top and bottom fitting together to form said carrying case, and said carrying case when closed comprising a substantially smoothly rounded contour having an oval body dimensioned to contain said deck of cards.

10. The combination as in claim 9 wherein said of said cards of said deck has a height to width ratio within the range of 3.0 to 3.8.

11. The combination as in claim 10 wherein said height to width ratio is within the range of 3.3 to 3.5.

12. The deck of cards as in claim 10 wherein said height to width ratio is approximately 3.4.

13. The combination as in claim 10 wherein said height of each of said cards is substantially five inches and said width of each of said cards is substantially one and one-half inches.

14. The combination as in claim 13 wherein said carrying case when closed has a longitudinal axial length of approximately six inches, a width of approximately two and one-half inches, and a depth of approximately one inch.

15. The combination as in claim 14 wherein said top and bottom of said carrying case are telescoping within each other and when closed overlap by approximately one-half inch.

16. The combination as in claim 9 wherein said carrying case has an oval visage.

17. The combination as in claim 16 wherein said carrying case has no sharp corners and no planar surfaces.

18. The combination as in claim 9 wherein said top and said bottom have axial lengths of approximately two and three-quarters inches and three and three-quarters inches, respectively.

19. The combination as in claim 9, wherein said top and bottom of said case snugly fit together when closed in a telescoping manner.

20. The combination as in claim 9, wherein said top and bottom of said case comprise rounded ends.

21. The combination as in claim 9, wherein said deck of cards are loosely contained in said carrying case.

22. The playing card/case combination of claim 9, wherein said rounded ends are semicircular.

23. A playing card/case combination, comprising:

at least one standard deck of playing cards, including playing cards divided into four suits, each suit including 13 differently ranked cards, each of said playing cards comprising a planar card having an elongated body with rounded ends and a height to width ratio of approximately 3.4for optimum holding and viewing of a hand of said cards when playing standard poker, bridge or similar card game; and a carrying case for said deck, said carrying case comprising a top and a bottom, said top and bottom fitting together to form said carrying case, and said carrying case when closed comprising a substantially smoothly rounded contour having an oval body dimensioned to contain said deck of cards and a height to width ratio of approximately 2.4.

24. A deck of cards, comprising:

at least one standard deck of pinochle playing cards comprising four suits and six pairs of differently ranked cards, each card comprising:

a planar body having a front, a back, an upper end and a lower end, said upper and lower ends being rounded and joined by a pair of substantially linear sides;

said back including a decorative image printed thereon;

said front including indicia designating said four suits and said six pairs of differently ranking cards of said standard deck of pinochle playing cards;

the longitudinal distance between said upper and lower ends defining the height of said card and the transverse distance between said pair of substantially linear sides defining the width of said card; and the height to width ratio of each of said cards being within the range of 3.0 to 3.8 for optimum holding and viewing of a hand of said cards when playing pinochle or a similar card game.

25. The deck of cards of claim 24 wherein said four suits comprise Spades, Hearts, Diamonds, and Clubs, and said six pairs of differently ranked cards comprise two Aces, two Kings, two Queens, two Jacks, two tens, two nines.

26. The deck of cards of claim 24, wherein said upper and lower ends are semicircular.

* * * * *